United States Patent [19]

Kinberger

[11] 4,377,011

[45] Mar. 22, 1983

[54] INFANT CRADLE

[76] Inventor: James Kinberger, P.O. Box 394, Stinson Beach, Calif. 94970

[21] Appl. No.: 222,173

[22] Filed: Jan. 2, 1981

[51] Int. Cl.[3] ..... A47D 9/00

[52] U.S. Cl. ..... 5/102; 5/98 A; 5/99 A

[58] Field of Search ..... 5/98, 99 A, 99 R, 102, 5/104, 105, 120, 122, 127; 297/45, 258, 259

[56] References Cited

U.S. PATENT DOCUMENTS

| | | | |
|---|---|---|---|
| 341,238 | 5/1886 | Heinss | 5/102 |
| 1,276,539 | 8/1918 | Juten | 5/112 |
| 1,436,834 | 11/1922 | Van Atti | 5/104 |
| 1,548,617 | 8/1925 | La Belle | 297/259 |
| 2,916,744 | 12/1959 | May et al. | 5/98 |
| 2,974,325 | 3/1961 | Mango | 5/98 A |
| 3,344,443 | 10/1967 | Bonnell | 5/120 |
| 3,430,273 | 3/1969 | Stillwaugh | 5/98 A |

FOREIGN PATENT DOCUMENTS

| | | | |
|---|---|---|---|
| 42684 | 6/1933 | France | 5/98 C |
| 969703 | 7/1937 | United Kingdom | 5/98 R |

*Primary Examiner*—Roy D. Frazier
*Assistant Examiner*—Michael F. Trettel
*Attorney, Agent, or Firm*—Manfred M. Warren; Robert B. Chickering; Glen R. Grunewald

[57] ABSTRACT

A cradle for an infant is disclosed which is collapsible and which provides several different rocking motions. The framework of the cradle is comprised of an outer frame with an inner frame suspended therein. The outer frame has an open position and a collapsed position and comprises two hoops connected at a first pair of pivots to pivot between the open and collapsed positions, the lower portions of the hoops serving as rockers. The inner frame comprises two U-shaped portions connected to each other at a second pair of pivots. The inner frame is connected to the outer frame at a third pair of pivots proximate the apexes of the U-shaped portions at opposite upper portions of the hoops equidistant from the pivots of the first pair, so that the inner frame can swing within the outer frame about the third pair of pivots. A collapsible receptacle is supported by the inner frame and oriented for side-to-side swinging motion about its longitudinal axis. Damping means is provided to damp the relative motion of the inner and outer frames. The cradle is capable of a rocking motion of the outer frame and a substantially independent swinging motion of the inner frame.

7 Claims, 3 Drawing Figures

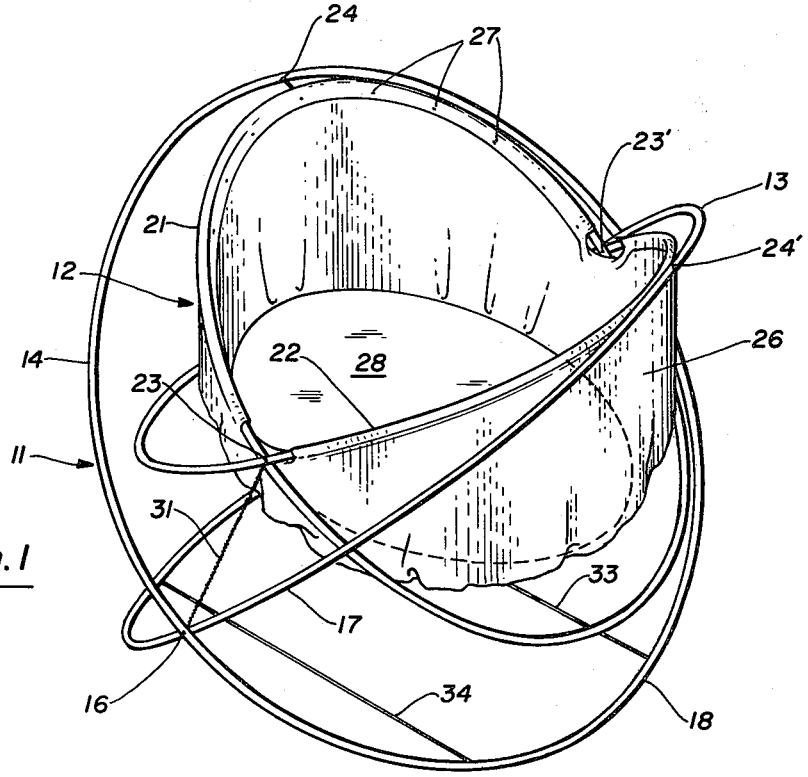
Fig. 1
Fig. 2
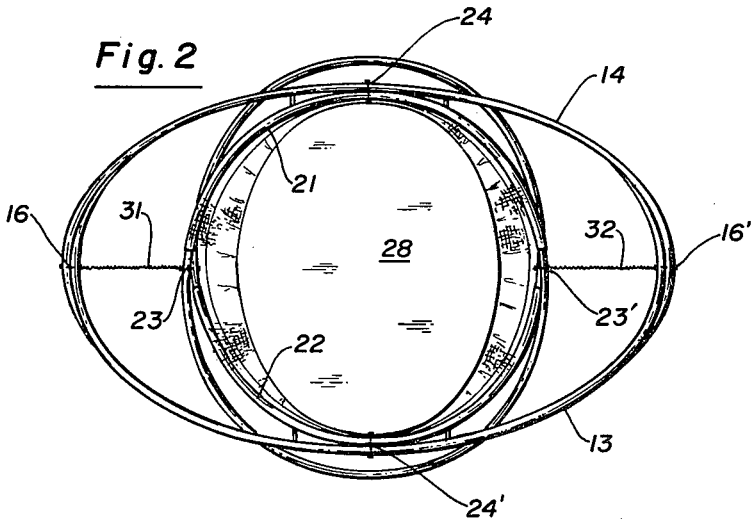
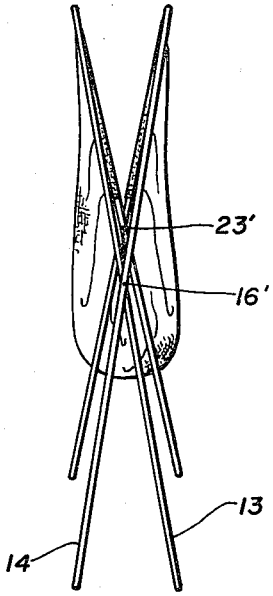
Fig. 3

INFANT CRADLE

BACKGROUND OF THE INVENTION

1. Field of the Invention

The invention relates to cradles for infants.

2. Description of the Prior Art

The soporific effects produced by gently rocking an infant have been recognized since antiquity to provide soothing relief to child and parent alike, and cradle makers have crafted many devices for lulling a child off to sleep. The typical cradle rocks about a base or pivot. This results in the traditional swaying-rocking mode in which the infant undergoes a small up-and-down motion in addition to the dominant side-to-side motion. Although other types of rocking motions have potentially soothing effects, they are not commonly found in cradles.

SUMMARY OF THE INVENTION

The invention is a cradle which has two different rocking modes having an enhanced soporific effect on the infant and providing greater amusement and diversion for the attending adult. The improved cradle disclosed herein moreover is collapsible to a shape and size which can be conveniently stored, for example in a closet, or carried in an automobile to social gatherings and the like. In addition, no tools are needed for its collapse or reassembly, which can be achieved very quickly with only a very slight effort.

The cradle of this invention includes an outer frame comprising two hoops connected at a first pair of pivots to pivot between an open position and a collapsed position, and rockers positioned on the hoop beneath the first pair of pivots when the outer frame is in its open position. The cradle further includes an inner frame comprising two U-shaped portions connected at a second pair of pivots to pivot between an open position and a collapsed position, and a third pair of pivots proximate the apexes of the U-shaped portions connecting them to opposite upper portions of said hoops equidistant from the first pair of pivots and equidistant from the second pair of pivots whereby said first pair and said second pair lie in a plane. A collapsible receptacle is supported by the inner frame. The receptacle preferably is elongated and oriented with its longitudinal axis parallel to the line joining the third pair of pivots when the outer frame is in its open position. Means is provided for damping relative motion of said inner and outer frames in the plane perpendicular to the line joining the third pair of pivots.

The invention described and claimed herein may be better understood with reference to the accompanying drawings, which depict a preferred embodiment of the invention and which are intended merely to illustrate rather than limit the invention in scope.

BRIEF DESCRIPTION OF THE DRAWINGS

FIG. 1 is an isometric view of a cradle in its open position constructed in accordance with the invention.

FIG. 2 is a top view of the cradle of FIG. 1 in its open position.

FIG. 3 is the cradle illustrated in FIG. 1 shown in its collapsed position.

DETAILED DESCRIPTION OF A PREFERRED EMBODIMENT

A cradle constructed in accord with the present invention includes an outer frame, illustrated generally at 11, and an inner frame, illustrated generally at 12. Outer frame 11 is comprised of two hoops 13 and 14 which are connected at a first pair of pivots 16 and 16'. The hoops 13 and 14 can be pivoted or rotated about the pivots 16 and 16' so as to move between an open position or configuration of outer frame 11 and a collapsed position or configuration. The open position can be seen in FIGS. 1 and 2, and the collapsed position in FIG. 3. Although hoops 13 and 14 are illustrated in the accompanying drawing to be generally circular in shape, they could just as well be elliptical or some other shape deviating from circularity in a regular or irregular manner. Nevertheless, as used herein the term hoop will be understood to include all such shapes.

To provide one type of rocking motion or mode, rockers are positioned on the bottom portion of hoops 13 and 14 beneath the first pair of pivots 16 and 16'. These rockers can be separate pieces which are secured to the bottom portions of hoops 13 and 14, or, as in the preferred embodiment illustrated in the figures, the lower portions of the hoops themselves can be shaped to provide the rockers as at 17 and 18.

The inner frame 12 is comprised of two U-shaped portions 21 and 22, which are connected together at a second pair of pivot points 23 and 23' to pivot between an open position and a collapsed position. For continuity of design U-shaped portions 21 and 22 can be provided by a second, smaller pair of hoops, fashioned after the first pair of hoops, as illustrated in the figures. Each U-shaped portion 21 or 22, however, need not form a closed figure and can assume a regular or irregular arcuate or polygonal shape.

Inner frame 12 and outer frame 11 are connected to each other at a third pair of pivots 24 and 24' located proximate the apexes of U-shaped portions 21 and 22. To facilitate movement to the collapsed configuration of the cradle and to enable a new and independent rocking mode, the apexes of U-shaped portions 21 and 22 are connected through pivot points 24 and 24' to opposite upper portions of the respective hoops of outer frame 11 at positions which are equidistant from the pivots 16 and 16'. Connected in this manner, inner frame 12 is suspended within outer frame 11 from the pivotal connections 24 and 24' and is free to rotate or swing about the axis connecting points 24 and 24' when the cradle is in its open position. Furthermore, the pivotal connections 24 and 24' being positioned in this manner will cause the first pair of pivot points 16 and 16' and the second pair of pivot points 23 and 23' to lie in a common plane when the cradle is in its open position and throughout the movement to the collapsed position.

The cradle of the present invention further includes a collapsible receptacle 26 having a generally elongated shape formed to hold an infant or small baby therein when the cradle is in its open position. Receptacle 26 is supported by inner frame 12 with its longitudinal axis running parallel to the line joining the pivot points 24 and 24'. That is, the longitudinal axis of receptacle 26 is oriented parallel to the axis about which it swings, so that a child nestled therein will rock from side of side in the manner of the traditional cradle, and not forward and back in the manner of a rocking chair.

Receptacle 26 is formed to be collapsible by moving the frames from the open to the closed position to the configuration shown in FIG. 3. In a preferred embodiment this is easily accomplished by forming the receptacle of flexible material, such as fabric or plastic sheet. All such flexible or pliable materials capable of conforming to a substantially planar shape are referred to herein as fabric. Receptacle 26 can then be conveniently suspended from inner frame 12 by folding the fabric material around U-shaped portions 21 and 22 and securing the fabric to itself by releasable fastener means 27, such as snap fasteners. Releasable fastener means enables the fabric basket to be easily removed for cleaning, repair and the like.

The fabric of receptacle 26 will generally hang freely in a manner similar to a hammock. To provide a flat sleeping surface, a rigid substantially flat member 28 can be placed in the receptacle to form its bottom, thereby providing a measure of structural integrity to the receptacle. Member 28 will conform with the elongated shape of the receptacle itself. It has been found that sufficient structural integrity is provided when member 28 is merely laid within receptacle 26 and is not secured thereto. Thus, member 28 can readily be removed when the cradle is to be collapsed. In this manner a cradle is provided, the receptacle of which has a flat bottom in its open position, yet which can readily be folded into its collapsed configuration. Receptacle 26 as disclosed herein, may be modified, e.g., by employing stays or the like within the fabric or hinged members within the rigid bottom to provide structural integrity while allowing for collapse.

As mentioned hereinabove, inner frame 12 is connected to outer frame 11 at the pivot points 24 and 24' such that frame 12 and receptacle 26 suspended therefrom are free to pivot about the line or axis joining the pivots 24 and 24'. Thus, inner frame 12 can undergo relative motion with respect to outer frame 11 in a direction perpendicular to the line joining the third pair of pivot points 24 and 24'. The cradle of the present invention includes means for damping this relative motion. In a preferred embodiment the damping is provided by two springs 31 and 32, each being held in tension between a pivot of the first pair 16 and 16' and a pivot of the second pair 23 and 23'. Thus, as seen in FIG. 1, spring 31 runs between pivot 16 of outer frame 11 and pivot 23 of inner frame 12, and spring 32 runs between the pivots 16 prime and 23'. It will readily be appreciated that the damping means can be provided by springs located in other positions and other arrangements utilizing dashpots and the like.

As explained above, outer frame 11 can pivot about the pivots 16 and 16' to its open position. Although the full longitudinal extent of inner frame 12 in its openmost position can serve to define the open position of outer frame 11, it has been found preferable to provide the cradle with means for restraining outer frame 11 from pivoting beyond a desired open position. In the embodiment shown in the figures, outer frame 11 is restrained from opening too far by restraining rods 33 and 34, which extend longitudinally between hoops 13 and 14. Rods 33 and 34 have hooked ends which are inserted into holes provided therefor in the lower portions of hoops 13 and 14. When installed, rods 33 and 34 prevent pivoting of outer frame 11 about the pivot points 16 and 16'. Rods 33 and 34, moreover, are readily removed to enable the cradle to be collapsed. Alternatively, outer frame 11 can be restrained from opening too far by a folding brace between hoops 13 and 14.

When the cradle described above is in its open position, it is capable of two different rocking motions or modes. In the first, traditional mode, inner frame 12 pivots about the third pair of pivot points 24 and 24' while outer frame 11 remains essentially stationary, thus producing a rocking motion in which the cradle swings beneath a horizontal axis. In the second rocking mode outer frame 11 is slowly rocked back and forth on rocker portions 17 and 18 while inner frame 12 pivots slowly about pivot points 24 and 24' to retain receptacle 26 substantially in its upright orientation throughout the rocking motion of outer frame 11. In this mode the baby is gently rocked from side to side in a linear fashion with the bottom of the basket remaining horizontal with little or none of the up and down aspect of the motion found in the traditional swaying-rocking mode. These two modes of motion can, of course, be combined to produce a number of different rocking motions.

When not in use, the cradle of the present invention can easily be collapsed for storage. Restraining rods 33 and 34 are simply removed, the member 28 is lifted out of the receptacle 26, and the inner and outer frames 11 and 12 are simultaneously pivoted about the pivot points 16, 16', 23, and 23' to a substantially planar configuration (see FIG. 4). The pivotal connections 24 and 24' are provided with enough slack or play to allow for the slight relative motion of frames 11 and 12 at these pivot points as the cradle is folded. Member 28 and rods 33 and 34 can then be conveniently stored within receptacle 26 in its collapsed configuration. For further convenience the cradle can be provided with a catch to hold the cradle in its closed position.

What is claimed is:

1. A cradle for a child comprising:

an outer frame comprising two hoops connected at a first pair of pivots to pivot between an open position and a collapsed position, and rockers positioned on said hoops beneath said first pair of pivots when said outer frame is in said open position;

an inner frame comprising two U-shaped portions connected at second pair of pivots to pivot between an open position and a collapsed position;

a third pair of pivots proximate the apexes of said U-shaped portions and connecting said U-shaped portions to opposite upper portions of said hoops equidistant from said first pair of pivots and equidistant from said second pair of pivots whereby said first pair and said second pair of pivots lie in a plane;

a collapsible receptacle, supported by said inner frame and oriented with its longitudinal axis parallel to the line joining said third pair of pivots when said outer frame as in said open position; and means for damping relative motion of said inner and outer frames in the plane perpendicular to theline joining said third pair of pivots.

2. The cradle of claim 1, wherein said hoops are shaped to provide said rockers.

3. The cradle of claim 1, wherein said inner frame comprises two inner hoops pivotally connected at diametrically opposed pivots.

4. The cradle of claim 1, wherein said receptacle is formed with fabric suspended from said inner frame.

5. The cradle of claim 4,
and a removable rigid substantially flat member forming the bottom of said receptacle.

6. The cradle of claim 1,
wherein said damping means comprises two springs, each held in tension between a pivot of said first pair of pivots and an adjacent pivot of said second pair of pivots.

7. The cradle of claim 1,
and means for restraining said outer frame from pivoting beyond a predetermined open position.

* * * * *